US007019584B2

(12) United States Patent
Bartel et al.

(10) Patent No.: US 7,019,584 B2
(45) Date of Patent: Mar. 28, 2006

(54) OUTPUT STAGES FOR HIGH CURRENT LOW NOISE BANDGAP REFERENCE CIRCUIT IMPLEMENTATIONS

(75) Inventors: Robert M. Bartel, Hillsboro, OR (US); Joey I. Doernberg, San Carlos, CA (US); Edward E. Miller, Beaverton, OR (US)

(73) Assignee: Lattice Semiconductor Corporation, Hillsboro, OR (US)

( * ) Notice: Subject to any disclaimer, the term of this patent is extended or adjusted under 35 U.S.C. 154(b) by 0 days.

(21) Appl. No.: 10/768,643

(22) Filed: Jan. 30, 2004

(65) Prior Publication Data

US 2005/0168270 A1 Aug. 4, 2005

(51) Int. Cl.
*G05F 1/10* (2006.01)

(52) U.S. Cl. ..... 327/539; 323/316

(58) Field of Classification Search ..... 327/530, 327/538, 539; 323/315, 316
See application file for complete search history.

(56) References Cited

U.S. PATENT DOCUMENTS 4,263,519 A * 4/1981 Schade, Jr. ..... 327/539
4,588,941 A * 5/1986 Kerth et al. ..... 323/314
5,081,410 A * 1/1992 Wood ..... 323/316
5,352,973 A * 10/1994 Audy ..... 323/313
5,966,039 A * 10/1999 Koglin et al. ..... 327/356
6,091,285 A * 7/2000 Fujiwara ..... 327/539
6,255,807 B1 * 7/2001 Doorenbos et al. ..... 323/314
6,489,835 B1 * 12/2002 Yu et al. ..... 327/539
6,529,066 B1 * 3/2003 Guenot et al. ..... 327/539
6,677,808 B1 * 1/2004 Sean et al. ..... 327/539
6,784,724 B1 * 8/2004 Takemura ..... 327/539
6,859,077 B1 * 2/2005 Huang et al. ..... 327/143
6,922,099 B1 * 7/2005 Shor et al. ..... 327/543
2005/0003767 A1 * 1/2005 Song ..... 455/75

* cited by examiner

*Primary Examiner*—Kenneth B. Wells

(57) ABSTRACT

A bandgap reference circuit can use various output stages to implement a controlled feedback method of sensing and supplying the needed load current through a sensing network. A small amount of circuitry can be added to a class AB output stage to decouple the bandgap reference feedback from a capacitive load and simultaneously sense load current needs and boost current as needed while minimizing voltage droop. Such circuits can be implemented using relatively compact designs while still reducing droop, and thus allowing the use of a large external capacitor to reduce noise and maintain good power supply rejection.

20 Claims, 4 Drawing Sheets

OUTPUT STAGES FOR HIGH CURRENT LOW NOISE BANDGAP REFERENCE CIRCUIT IMPLEMENTATIONS

TECHNICAL FIELD

The present invention relates to integrated circuits, and particularly to bandgap reference circuits.

BACKGROUND

Analog circuits typically make extensive use of voltage and current references. Such references are DC quantities that exhibit little dependence on power supply and fabrication process parameters, while also demonstrating a well-defined (or preferably no) dependence on temperature. Perhaps the most commonly implemented reference circuit is the bandgap reference circuit.

As is known, bandgap reference voltage circuits provide a substantially constant output reference voltage over a temperature range. To accomplish this, bandgap references provide temperature compensation so that the output reference voltage does not vary with temperature. Generally, the output reference voltage is a function of the base-to-emitter voltage ($V_{be}$) of one bipolar transistor and the difference between the base-to-emitter voltages ($\Delta V_{be}$) of a pair of bipolar transistors having different associated current densities. The value of the temperature independent reference voltage is generally adjusted by scaling $\Delta V_{be}$. This arrangement provides the desired temperature compensation since $V_{be}$ of a bipolar transistor has a negative temperature coefficient while $\Delta V_{be}$ of a pair of bipolar transistors has a positive temperature coefficient. Thus, the temperature variations of the $V_{be}$ and the $\Delta V_{be}$ terms establishing the reference voltage can be made to cancel, thereby providing an output reference voltage that is essentially constant with respect to temperature.

Many conventional bandgap reference designs exist for producing stable reference voltages while driving relatively small load currents, e.g., 100 μA. However, some applications require reference voltages that can drive larger currents, e.g., currents on the order of 400 μA or greater. As the output current of a bandgap reference circuit increases, certain performance characteristics of the circuit become more difficult to control and/or the those performance characteristics become more important to overall circuit operation. For example, when driving large load currents it can be difficult to maintain as small a reduction in reference voltage (sometimes called "droop") as possible. Moreover, maintaining low noise output can become more complicated with higher output current bandgap references. For example, one common noise reduction technique is to couple the output of the bandgap reference to a relatively large capacitance. With a Class A output stage, the large capacitor is the compensation capacitor and the dominant pole in the feedback loop, but the drive capability of this stage is very limited. With a Class AB output stage, the output is usually not the dominant pole and the large capacitor can cause the output and hence the feedback path to have too much phase shift and cause oscillations. Also, because the Class AB output is a lower impedance, the noise reduction is limited. Unfortunately, driving large capacitive loads can cause an additional pole in the feedback response of the amplifier used in conjunction with the reference devices. In addition, bandgap architectures frequently have more than one stable operating point. An additional stable operating point is often at 0 V and thus a "start-up" circuit must be added to avoid this undesired operating point. Still another concern is the ability to maintain relatively high Power Supply Rejection (PSR) for the bandgap reference.

One approach to the problem of producing high output current bandgap references is by using a bipolar technology, because of the higher device gain and lower device impedance for a given current. Unfortunately, such an approach is frequently not possible on standard CMOS technology processes due to non-existent or very poor bipolar transistors.

Accordingly, it is desirable to have bandgap reference circuit implementations that provide high output current yet still have relatively low noise output, have low voltage droop, have suitable levels of power supply rejection, and avoid settling into an intermediate or undesirable state.

SUMMARY

It has been discovered that a bandgap reference circuit can use various output stages to implement a controlled feedback method of sensing and supplying the needed load current through a sensing network. A small amount of circuitry can be added to a class AB output stage to decouple the bandgap reference feedback from a capacitive load and simultaneously sense load current needs and boost current as needed while minimizing voltage droop. Such circuits can be implemented using relatively compact designs while still reducing droop, and thus allowing the use of a large external capacitor to reduce noise and maintain good power supply rejection.

Accordingly, one aspect of the present invention provides a circuit including a bandgap reference circuit, a first output stage, and a second output stage. The bandgap reference circuit includes a differential amplifier having a first amplifier input, a second amplifier input, and an amplifier output. A first transistor is coupled to the first amplifier input. A second transistor is coupled to the second amplifier input. The first output stage is coupled to the amplifier output, and includes a first device and a second device, wherein a node common to the first device and the second device comprises a first output stage output. The second output stage is coupled to the first output stage output, and includes a resistor and a feedback node coupled to at least one of the first amplifier input and the second amplifier input.

Another aspect of the present invention provides a method. A bandgap reference voltage signal is generated. A current of the bandgap voltage signal is increased. The bandgap reference voltage having an increased current is provided to a resistor. The bandgap reference voltage having an increased current is sensed at a first node of the resistor, wherein the sensing results in a sensed current. The sensed current is mirrored to a second node of the resistor. A feedback signal from the first node of the resistor is used as part of the bandgap reference voltage signal generation.

The foregoing is a summary and thus contains, by necessity, simplifications, generalizations and omissions of detail; consequently, those skilled in the art will appreciate that the summary is illustrative only and is not intended to be in any way limiting. As will also be apparent to one skilled in the art, the operations disclosed herein may be implemented in a number of ways, and such changes and modifications may be made without departing from this invention and its broader aspects. Other aspects, inventive features, and advantages of the present invention, as defined solely by the claims, will become apparent in the non-limiting detailed description set forth below.

BRIEF DESCRIPTION OF THE DRAWINGS

A more complete understanding of the present invention and advantages thereof may be acquired by referring to the following description and the accompanying drawings, in which like reference numbers indicate like features.

DETAILED DESCRIPTION

The following sets forth a detailed description of at least one way for carrying out the one or more devices and/or processes described herein. The description is intended to be illustrative and should not be taken to be limiting.

Figure 1:
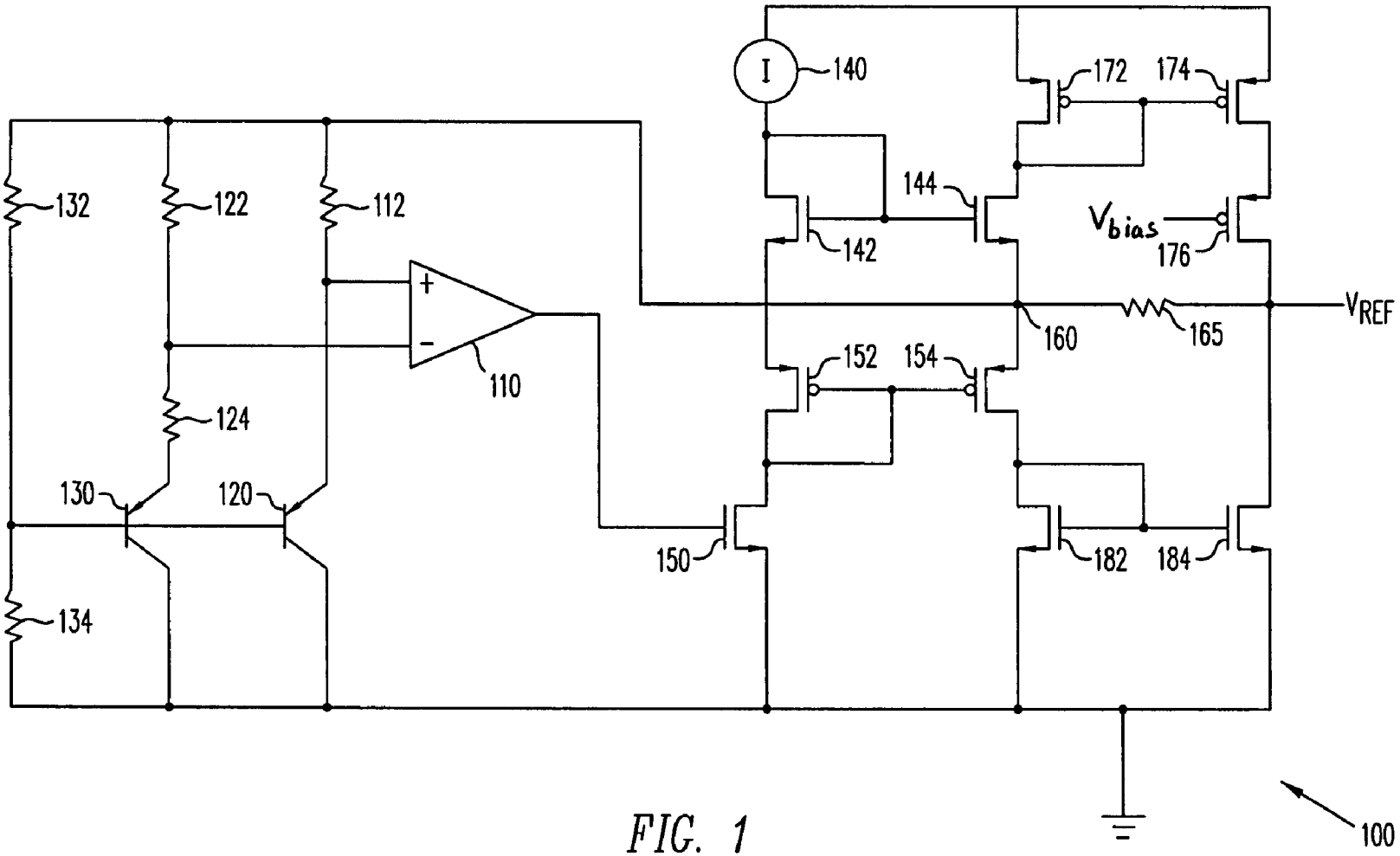
FIG. 1 illustrates a simplified schematic diagram of a bandgap reference circuit including two output stages.

FIG. 1 illustrates a simplified schematic diagram of a circuit 100 including a core bandgap reference circuit and two output stages used to produce a reference voltage $V_{ref}$. The core bandgap reference circuit is formed from amplifier 110, resistors 112, 122, 132, 124, 134, and transistors 120 and 130. In a typical implementation, transistors 120 and 130 are scaled versions of each other, where one transistor is a specified multiplying factor larger than the other. Amplifier 110 senses the voltages at the bottom nodes of each of resistor 112 and 122 and attempts to hold those nodes at approximately equal voltages via feedback to the top nodes of resistors 112 and 122. In prior art bandgap references, the output of amplifier 110, which would be the voltage reference, is the feedback signal. As discussed below, circuit 100 uses a controlled feedback method of sensing and supplying the needed load current through a sensing network. The values of resistors 112, 122, and 124 are typically chosen in conjunction with the ratio of the sizes of transistors 120 and 130 so as to ensure that the temperature coefficient of the circuit is zero at a temperature such that total temperature drift over the specified range is minimized.

Although many typical bandgap reference circuits are designed to provide a nominal 1.25 V reference signal, the circuit shown is modified to produce a different reference voltage, e.g., 2.5 V. Thus in circuit 100, the bases of PNP transistors 120 and 130 are tied together to the center node of a voltage divider formed by resistors 132 and 134. Bandgap reference circuits like this usually have more than one stable operating state. e.g., a low voltage (intermediate) state between 0 V and the desired reference voltage level. This is in addition to the zero voltage state possible in all bandgap reference circuits. For this bandgap designed to output 2.5V, the low voltage state is approximately 1.2V. This is in addition to the zero-voltage state possible in all bandgap reference circuits. As will be seen with respect to FIGS. 2A and 2B below, a startup circuit can be implemented that will sense the low output state and drive a current into the positive input amplifier 110 to increase the output voltage and drive the output to the second stable state, the desired reference level of 2.5 V. As the circuit approaches the second stable state the startup circuit is disabled and has no effect on the circuit operation. If the output is pulled low, the startup circuit will automatically start to function again. As shown, transistors 120 and 130 are PNP bipolar devices. This implementation is often preferable because it allows for the bipolar devices that are preferred for bandgap references. This is generally compatible with the CMOS process technologies typically used to implement analog and mixed-signal integrated circuits.

The first output stage is generally formed from current source 140 and transistors 142, 144, 152, 154, and 150. These devices form a conventional class AB output stage. This type of output stage is used in conjunction with amplifier 110 to provide higher output current drive and lower output impedance. Although this stage can provide desired current levels and output impedance, it does not address the problem of output noise levels. In some cases, noise can be suppressed through the use of additional circuit elements internal to circuit 100. Unfortunately, such an approach creates added complexity, often uses excessively large devices, and may also cause excessive power consumption. Instead, circuit 100 is designed to provide noise suppression through the addition of a relatively large (e.g., 1 μF to 10 μF) capacitor typically located external to the circuit.

In circuit 100, the bandgap feedback loop is the feedback from the sources of transistors 144 and 154 (i.e., feedback node 160) back to the transistors used to generate $\Delta V_{be}$. Choosing this form of feedback to the core bandgap reference circuit reduces the output impedance of the node made by the sources of transistors 144 and 154 while still regulating the bandgap voltage. As a load impedance of circuit 100 is changed, a current will flow through resistor 165 from either transistor 144 or transistor 154 depending on whether current is being sourced or sunk by circuit 100. This is generally because transistors 174 and 176 (part of the second output stage) have high impedance. The current is sensed at feedback node 160 and mirrored by current mirrors (transistors 172 & 174, and transistors 182 & 184). The amount of mirrored current, and thus also the current through resistor 165, depends generally on the ratio of the dimensions of the mirror devices. For example, assuming that current mirror devices 174 and 172 have a ratio of $\alpha=I_{174}/I_{172}$, then if a is greater than one, the majority of current is supplied not through resistor 165, but from the current mirrors. As will be seen below, this technique helps to maintain high output current, while reducing the amount of voltage droop associated with resistor 165. Thus, resistor 165 can be included, e.g., for use in noise reduction along with an external capacitor, without adversely affecting the performance of circuit 100.

Operation of the second output stage can be better understood by way of example. Considering the case where circuit 100 sources current, i.e., considering only the operation of transistors 172 and 174 and not that of transistors 182 and 184, the total current ($I_t$) driven into a load by circuit 100 is the sum of the current through resistor 165 ($I_r$) and the current from the current mirror $I_{174}$ ($I_m$). Based on the aforementioned relationship of the current mirror devices, it can be seen that $I_m=\alpha \cdot I_r$. Thus, the two constituent currents can be written in terms of $\alpha$ and $I_t$ as $I_r=I_t/(1+\alpha)$ and $I_m=I_t \cdot \alpha/(1+\alpha)$. The current supplied by the first output stage (i.e., a traditional class AB output stage) is reduced by a factor of $1/(1+\alpha)$. This current must flow through resistor 165, so any voltage droop associated with circuit 100 is the droop caused by the reduced current level of the first output stage across resistor 165. If, for example, $\alpha=10$, then transistor 174 nominally provides ten times the current that flows through resistor 165. Providing most of the current through the mirrors of the second output stage effectively reduces droop problems. Moreover, use of cascode device 176 (suitably biased) will help ensure that the current from the current mirror is adequately constant, thereby providing a measure of power supply rejection to circuit 100.

Additionally, if the value of resistor 165 is selected properly it can decouple any output capacitance added at the load, leaving the bandgap voltage feedback portion of the amplifier stable regardless of the value of an external capacitor. Resistor 165 and an external capacitor form a low pass filter that can then filter the output noise of the bandgap reference feedback circuit. In general, the value of resistor 165 can also be selected by considering certain tradeoffs: smaller values tend to effect feedback stability, while larger values tend to accentuate droop problems. Thus, in various embodiments the starting point for component value selection will typically be one or more performance specifications such as maximum droop, maximum output noise, and the like. Thus, in one example a value of less than 20 ohms is selected for resistor 165 in order to keep the voltage change with current sinking and sourcing low. The low resistance value, coupled with the low output impedance of the feedback network, can result in the loop gain of the second output stage being less than one at DC. The loop gain does not typically remain one because as frequency increases, the output impedance of the bandgap reference voltage circuit with feedback increases due to falling loop gain. This effect begins at the dominant pole frequency of the bandgap reference voltage feedback circuit. This pole typically occurs at a low frequency value, e.g., a few kilohertz. Consequently, a compensation capacitor applied to the bandgap output is typically used to roll off this gain increase before loop gain goes above one and thus cause instability and/or oscillations.

Figure 2A:
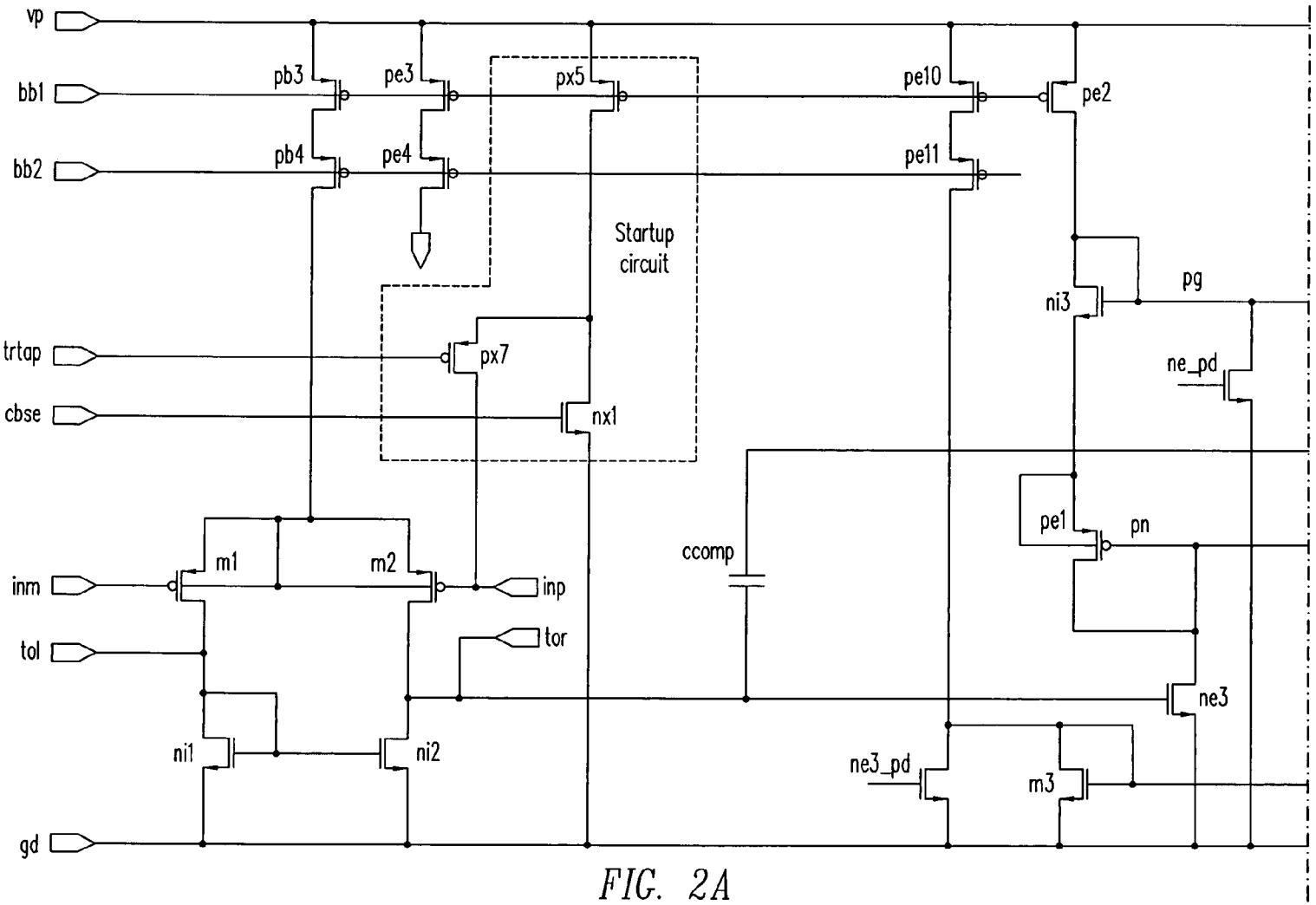
FIGS. 2A–2B illustrate a more detailed schematic diagram of an implementation of bandgap reference output stages and a startup circuit.
Figure 2B:
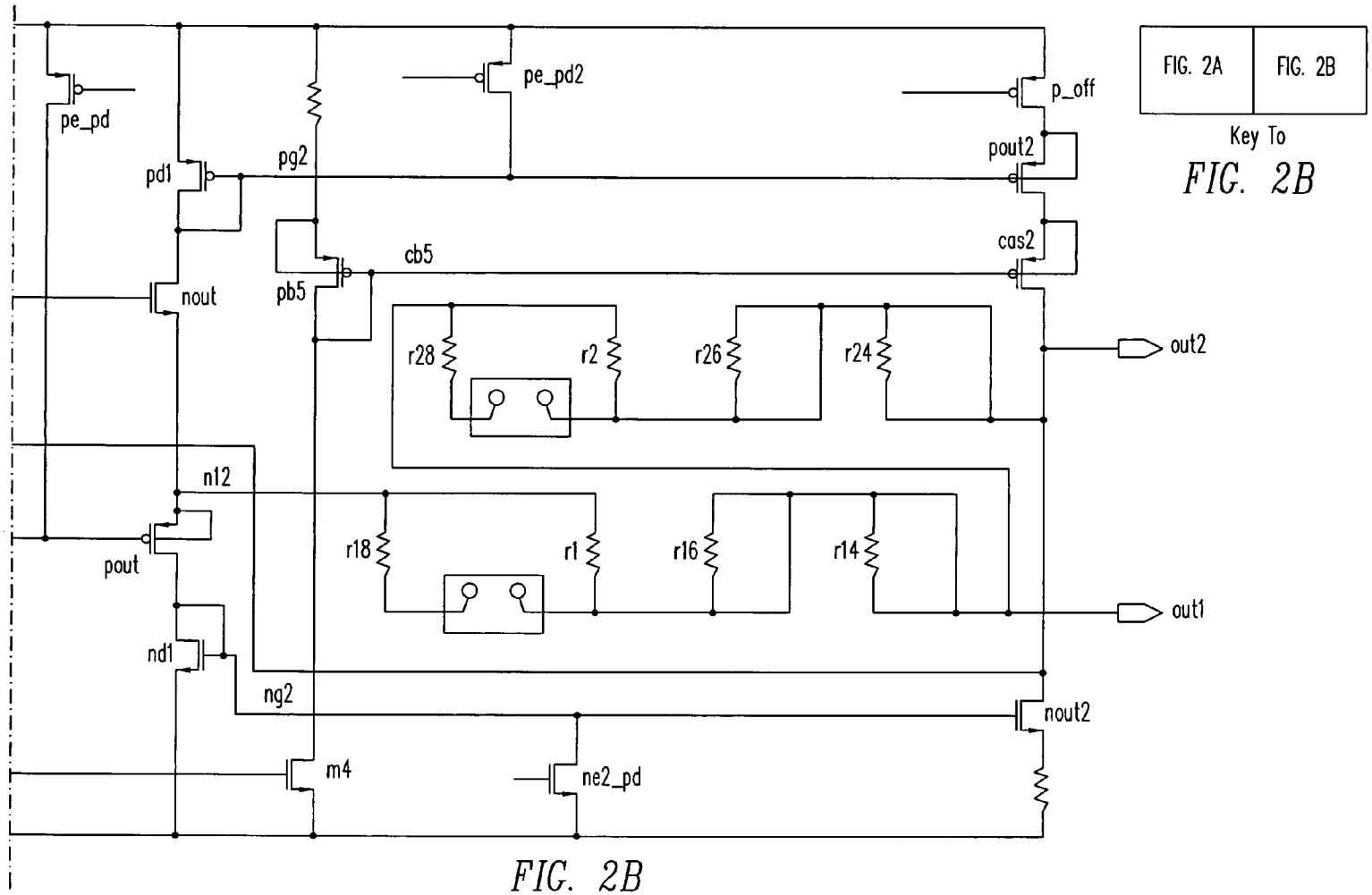

FIGS. 2A–2B illustrate a more detailed schematic diagram of an implementation of bandgap reference output stages and a startup circuit. In these figures, certain bandgap reference devices, such as bandgap reference resistors and bipolar devices are not shown for convenience. As is the case with circuit 100, the circuit of FIGS. 2A and 2B includes core bandgap reference circuitry and two output stages. Thus, the design illustrated can be thought of as a two stage operational amplifier, where the output stage is itself two separate stages. The first output stage will output some current, but is mainly a current sensing stage for the second stage that provides most of the drive current. The high impedance output of the second stage allows resistor 165 and the external capacitor to act as a first order low pass filter to reduce the output noise.

The input stage is a conventional PMOS input differential pair m1 & m2 where transistors ni1 & ni2 provide the first stage loads. Trim currents can be provided at nodes tol and tor (by an external circuit not shown) so that the reference output voltage can be adjusted to a specified voltage, e.g., 2.5 V. The output of the first stage at node tor drives transistor ne3 and has a current-source load pe2. Between transistors ne3 and pe2 are diode-connected devices pe1 and ni3. The voltage difference between nodes pg (the gate of transistor ni3) and pn (the gate of transistor pe1) is the sum of the gate-source voltages of pe1 and ni3. These two voltages drive the first output stage, a class AB output stage having an output node n12. Source follower devices nout and pout are used for their large current drive capability. Additionally, both NMOS and PMOS devices are used so the circuit has the ability to both source and sink current.

As noted above, a second output stage is added that works in conjunction with the first output stage to reduce output reference signal noise. In series with the first output stage source followers are devices nd1 and pd1, which are diode-connected transistors having their gate voltages at nodes ng2 and pg2 respectively. These devices drive the second output stage devices nout2 and pout2 and the output stage includes a high impedance output node out2. Node out2 is the reference signal provided by the circuit. Cascode device cas2 is provided to further increase the output impedance of the second output stage and to increase power supply rejection. Current source pe10 drives transistor m3, which mirrors current to transistor m4, and the gate-source voltage of transistor pb5 generates the voltage at node cb5 for the gate of cascode cas2.

Although the output resistor 165 of circuit 100 is shown as a single resistor, many embodiments, such as that illustrated in FIGS. 2A and 2B implement multiple resistors. Thus, the two output stages are generally coupled by resistors r1 and r2, where r1 is coupled from the output of the first output stage (node n12) to node out1, and resistor r2 is coupled from node out1 to output node out2. However, the specific embodiment is shown with additional resistive devices allowing for trim (e.g., via laser cutting of traces in parallel with resistors r16 and r14) and/or characterization (e.g., via the contact pads between resistors r1 and r18). In still other embodiments, user programmable resistive devices can be implemented. Each of the resistors r1 and r2 have a direct impact on bandgap reference voltage droop, output noise, and power supply rejection, and thus typical implementations provide some mechanism for optimizing the values of the resistors. Moreover, while the voltage at node out2 is the bandgap reference voltage generated by the circuit, the voltage at node out1 (i.e., the voltage developed across resistor r1 alone) is used as the feedback signal. Referring then to FIG. 1, the voltage developed by out1 would be, for example, applied to the top nodes of resistors 112, 122, and 132. In this example, two resistors are used to decouple the feedback voltage, out1, from the output voltage, out2.

The primary compensation for the feedback in the amplifier is the capacitor between out2 and tor. The external capacitor does not provide any additional compensation to the feedback in the amplifier. Instead, the addition of resistance 165 serves this purpose. It is primarily for compensation of the feedback in the second stage output driver and for noise reduction. Devices ne2_pd, ne3_pd, pe_pd, and pe2_pd force various device gates to the power supply rail (vp) and ground (gd) as appropriate in order to turn off currents during a power-down mode of operation and according to appropriate power-down signals (not labeled) applied to their device gates.

In order to keep the bandgap reference circuit from either settling into an intermediate voltage state or the zero-voltage/zero-current state, a startup circuit is implemented. For example, when power is applied to the operational amplifier at the heart of this circuit, the amplifier can be in a state with very little gain and where it does not supply enough current to the bandgap resistors (e.g., resistors like 112, 122, 124, 132, and 134 of FIG. 1) and PNP transistors (such as transistors 120 and 130 of FIG. 1). The startup circuit implemented includes devices px5, nx7, and nx1. Transistor px5 provides a current source. Upon starting, node trtap is at 0 V, thereby turning on transistor px7 which in turn pulls up the emitter of the PNP device coupled to node inp. As the reference voltage increases, the gate-source voltage transistor px7 decreases. When node cbse, which is tied to the bases of both PNP devices, rises above approximately 0.7 V, then nx1 turns on and shunts current from current source px5 away from px7 and the bandgap is in the normal operation. The gate of px7 is tied to node trtap so that nx1 does not draw current from node inp when the output voltage is still below the desired output level, which would occur if the gate were tied to node cbse. Sufficient headroom from trtap to the supply voltage for adequate px7 gate-source voltage is important, and therefore this headroom exists in this design.

Assuming that the circuit is in the undesirable intermediate state, e.g., 1.2 V, the voltage on node cbse is less than 0.4 V. The voltage on node trtap is close to 1.2 V. This turns on transistor px7 and leaves off transistor nx1. In this configuration, the current from current source device px5 is pushed into PNP transistor 120 at the amplifier's positive input (inp). This input is essentially a diode, and the current causes the diode voltage to increase thereby forcing the output voltage to increase. If the increase in voltage on the positive amplifier input is high enough and the amplifier gain is high enough, the amplifier and feedback loop will be pushed out of this stable but undesirable state (1.2 V) and toward the next stable state (2.5 V). As the amplifier approaches the 2.5 V state, the voltage on cbse rises toward 1.25 V and will turn on device nx1 which shunts current away from device px7 and lowers the voltage on the node between nx1 and px5 below the gate voltage trtap on device px7. Under these circumstances, the startup circuit is turned off. If the voltage at cbse falls near the threshold voltage of nx1, the startup circuit will activate again and pull the amplifier back to 2.5 V.

Numerous variations and modifications to the circuits described in FIGS. 1, 2A, and 2B will be known to those having ordinary skill in the art. For example, many of the resistors illustrated can be implemented using a variety of programmable and/or trimable devices. Similarly, the disclosed devices and techniques are not necessarily limited by any transistor, resistor, or capacitor sizes or by voltage levels disclosed herein. Moreover, implementation of the disclosed devices and techniques is not limited by CMOS technology, and thus implementations can utilize NMOS, PMOS, and various bipolar or other semiconductor fabrication technologies. While the disclosed devices and techniques have been described in light of the embodiments discussed above, one skilled in the art will also recognize that certain substitutions may be easily made in the circuits without departing from the teachings of this disclosure. For example, a variety of logic gate structures may be substituted for those shown, and still preserve the operation of the circuit, in accordance with DeMorgan's law. Also, many circuits using NMOS transistors may be implemented using PMOS transistors instead, as is well known in the art, provided the logic polarity and power supply potentials are reversed. In this vein, the transistor conductivity type (i.e., N-channel or P-channel) within a CMOS circuit may be frequently reversed while still preserving similar or analogous operation. Moreover, other combinations of output stages are possible to achieve similar functionality.

The voltage references described herein can find use as dedicated integrated circuit voltage references, or as parts of other integrated circuits including ADCs and DACs. In one embodiment, a voltage reference such as one of those illustrated in FIGS. 1, 2A, and 2B, is included as part of a programmable analog integrated circuit. Analog integrated circuits typically use some type of programmable analog circuit block architecture that permits change in one or more functions of the analog circuit without changing the topology of the circuit elements, thereby reducing changes in offset voltage and distortion created by changes in topology and making configuration or reconfiguration of the analog circuit block simpler for users.

Figure 3:
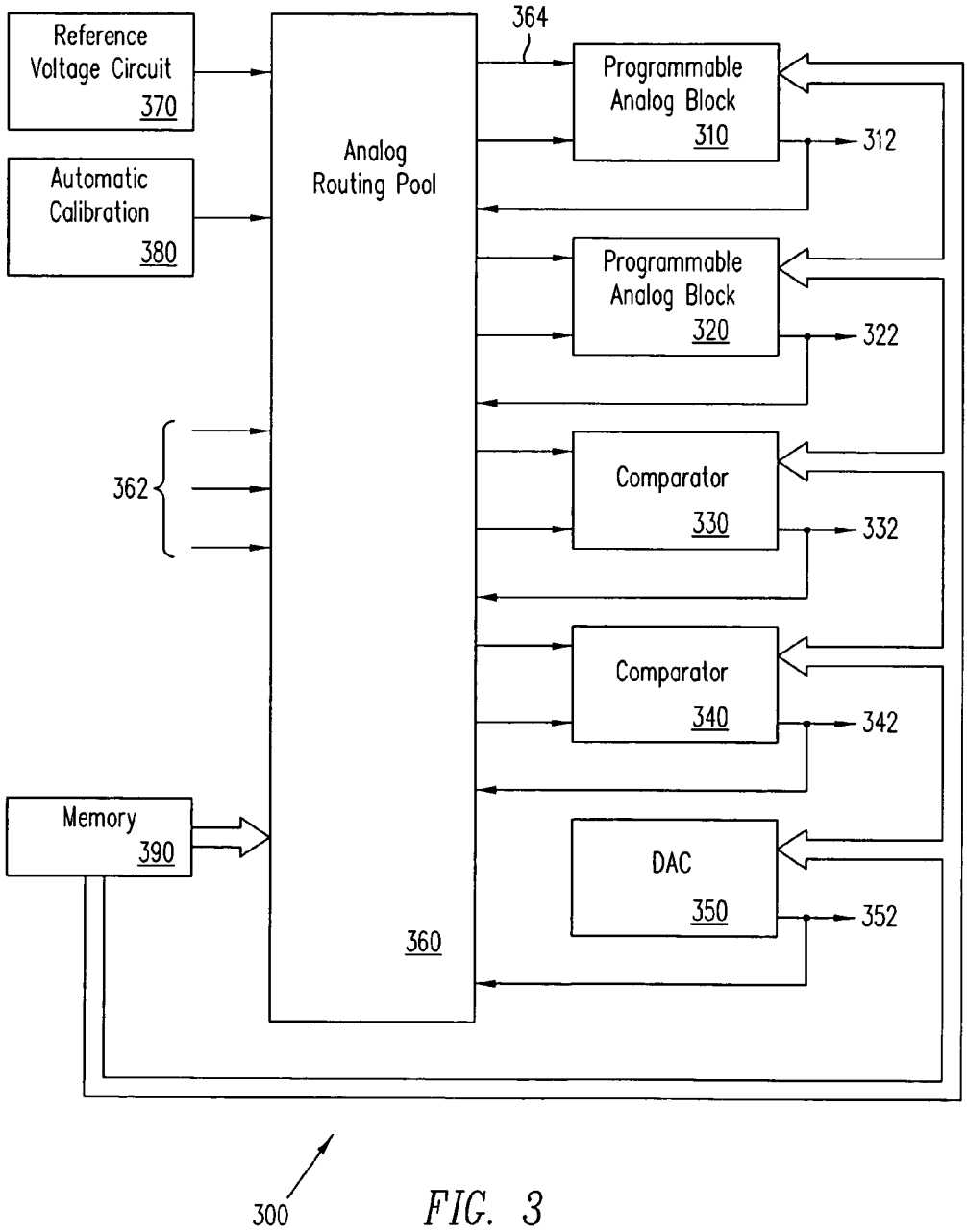
FIG. 3 is a simplified block diagram of a programmable analog integrated circuit including a reference circuit such as those described in FIGS. 1 and 2.

FIG. 3, illustrates a programmable analog integrated circuit 300 including two programmable analog circuit blocks 310 and 320, two comparator blocks 330 and 340, a digital-to-analog converter (DAC) 350, and an analog routing pool 360. Programmable analog integrated circuit 300 also includes support circuitry coupled to interconnect array 360, such as voltage reference circuit 370 (e.g., such as the reference circuits described in the present application), power-on auto-calibration circuitry 380, and configuration memory 390. Single-ended or differential input signals 362 are received by analog routing pool 360, and can be routed to any of programmable analog circuit blocks 310 and 320, comparator blocks 330 and 340, and external output terminals (not shown), depending upon the programming of analog routing pool 360. Analog routing pool 360 also controls the routing of the output signals of each of the programmable analog circuit blocks 310 and 320, comparator blocks 330 and 340, differential output DAC 350, and external output terminals.

The routing of the analog routing pool is determined by information stored in memory 390. More specifically, individual bits stored within memory 390 control whether individual switches of analog routing pool 360 are on or off. Memory 390 also stores similar information for programming the programmable analog circuit blocks 310 and 320, the comparators 330 and 340, DAC 350, and possibly voltage reference circuit 370.

Memory 390 can be implemented using both non-volatile and volatile memories, such as static read only memory, dynamic random access memory, static random addressable memory, shift registers, electronically erasable ($E^2$) memory, and flash memory. Reference voltage circuit 370 provides a stable voltage reference, e.g., 2.5 V, for use throughout programmable analog integrated circuit 300. Reference voltage circuit 370 can provide the voltage reference via analog routing pool 360 and/or via direct connection, e.g., to DAC 350, not shown.

Programmable analog circuit blocks 310 and 320 can include operational amplifiers, resistors, capacitors, and other basic analog circuit elements. Examples of typical programmable analog circuit blocks 310 and 320 can be found in U.S. Pat. No. 5,574,678, entitled "Continuous Time Programmable Analog Block Architecture," by James L. Gorecki, (the "Gorecki patent") which is incorporated herein by reference in its entirety. In general, programmable analog circuit blocks 310 and 320 flexibly implement basic analog circuit functions such as precision filtering, summing/differencing, gain/attenuation, and integration.

Programmable analog circuit blocks 310 and 320 can be implemented as single-ended circuit blocks, although in some embodiments, they are fully differential from input to output. Note that for simplicity in FIG. 3 (as well as FIG. 5), each of input signals 362, each of the two input signals to programmable analog circuit blocks 310 and 320, each of the two input signals to comparator blocks 330 and 340, and each of the output signals 312, 322, 332, 342, and 352 are shown as single lines, even though they each may represent either a single-ended signal or a differential signal pair. The circuits illustrated can be implemented with fully differential circuit pathways in some embodiments, although single-ended operation is possible by design, by programming, or via conversion circuits at the input and output nodes. Differential architecture substantially increases dynamic range as compared to single-ended I/O, while affording improved performance with regard to circuit specifications such as common mode rejection and total harmonic distortion.

Moreover, differential operation affords added immunity to variations in the circuit's power supply.

Automatic calibration circuit 380 is used to calibrate circuit elements of programmable analog integrated circuit 300, such as programmable analog circuit blocks 310 and 320. Typically, a calibration mode is initiated by, for example, a circuit power on signal (i.e., anytime the circuit is turned on) or by a specific calibrate command signal that allows calibration to be requested at any time. In one embodiment, simultaneous successive approximation routines are used to determine the amount of offset error referred to each of the output amplifiers used in programmable analog circuit blocks 310 and 320. That error is then nulled by a calibration DAC for each output amplifier. The calibration constant can be stored in memory 390, but is preferably recomputed each time programmable analog integrated circuit 300 enters a calibration mode.

In many applications using comparators, it is desirable to compare a signal to a known reference. This can be accomplished with programmable analog integrated circuit 300 in a variety of ways. For example, a reference signal can be coupled to one of the inputs 362, and subsequently routed to one or both of the comparators 330 and 340 via analog routing pool 360. Similarly, an output signal from one of the programmable analog circuit blocks 310 and 320 can be routed to one or both of the comparators 330 and 340 via analog routing pool 360. Finally, DAC 350 can be programmed to produce a analog signal that is routed to one or both of the comparators 330 and 340 via analog routing pool 360.

Regarding terminology used herein, it will be appreciated by one skilled in the art that any of several expressions may be equally well used when describing the operation of a circuit including the various signals and nodes within the circuit. Any kind of signal, whether a logic signal or a more general analog signal, takes the physical form of a voltage level (or for some circuit technologies, a current level) of a node within the circuit. Such shorthand phrases for describing circuit operation used herein are more efficient to communicate details of circuit operation, particularly because the schematic diagrams in the figures clearly associate various signal names with the corresponding circuit blocks and node names.

Although the present invention has been described with respect to a specific preferred embodiment thereof, various changes and modifications may be suggested to one skilled in the art and it is intended that the present invention encompass such changes and modifications that fall within the scope of the appended claims.

What is claimed is:

1. A circuit comprising:

a bandgap reference circuit including:

a differential amplifier having a first amplifier input, a second amplifier input, and an amplifier output;

a first transistor coupled to the first amplifier input; and a second transistor coupled to the second amplifier input;

a first output stage coupled to the amplifier output; wherein the first output stage includes a first device and a second device, wherein a node common to the first device and the second device comprises a first output stage output;

a second output stage coupled to the first output stage output, wherein the second output stage includes a feedback node coupled to at least one of the first amplifier input and the second amplifier input; and a start-up circuit configured to prevent the bandgap reference circuit from settling into an intermediate voltage state, the start-up circuit comprising:

a current source; and a transistor coupled between the first amplifier input and the current source, wherein the transistor includes a gate configured to receive a voltage derived from the feedback node, and wherein the transistor is configured to push current from the current source into the first amplifier input when the voltage derived from the feedback node is indicative of the intermediate voltage state.

2. The circuit of claim 1 wherein the first transistor is a first bipolar transistor having a first base, the second transistor is a second bipolar transistor having a second base, and wherein the first base is coupled to the second base.

3. The circuit of claim 2 wherein the bandgap reference circuit further comprises:

a first resistor coupled between the feedback node and the first and second bases; and a second resistor coupled to the first and second bases.

4. The circuit of claim 1 wherein the bandgap reference circuit further comprises:

a first resistor coupled between the first amplifier input and the feedback node; and a second resistor coupled between the second amplifier input and the feedback node.

5. The circuit of claim 1 wherein the first device and a the second device are coupled in series to form a source follower.

6. The circuit of claim 5 wherein the first output stage further comprises:

a first diode device coupled to the first device of the source follower; and a second diode device coupled to the second device of the source follower.

7. The circuit of claim 1 wherein the first output stage is a class AB output stage.

8. The circuit of claim 1 wherein the second output stage further comprises a feedback resistor coupled between the feedback node and the second output stage output.

9. The circuit of claim 8 wherein the resistor of the second output stage is a programmable resistor.

10. The circuit of claim 1 wherein the second output stage further comprises:

a resistor;

an output node, wherein the resistor is coupled between the output node and the feedback node; and a current mirror coupled between the feedback node and the output node, wherein the current mirror is operable to sense a current at the feedback node and provide a current at the output node.

11. The circuit of claim 1 further comprising:

a memory coupled to the analog routing pool, the memory storing information for use in programming the analog routing pool.

12. The circuit of claim 1, including:

a programmable analog circuit block, the programmable analog circuit block having analog circuit block positive and negative input terminals and analog circuit block positive and negative output tenrminals; and an analog routing pool, the analog routing pool controlling the routing of at least one of a signal provided by the programmable analog circuit block, and a signal provided to the programmable analog circuit block.

13. A circuit comprising:

a bandgap reference circuit including a differential amplifier having a first amplifier input, a second amplifier input, and an amplifier output;

a feedback node coupled to at least one of the first amplifier input and the second amplifier input; and a start-up circuit configured to prevent the bandgap reference circuit from settling into an intermediate voltage state, the start-up circuit comprising:

a current source; and a transistor coupled between the first amplifier input and the current source, wherein the transistor includes a gate configured to receive a voltage derived from the feedback node, and wherein the transistor is configured to push current from the current source into the first amplifier input if the voltage derived from the feedback node is indicative of the intermediate voltage state.

14. The circuit of claim 13, wherein the bandgap reference circuit includes a first bipolar transistor having a first base coupled to the first amplifier input, a second bipolar transistor having a second base coupled to the second amplifier input, and wherein the first base is coupled to the second base.

15. The circuit of claim 13 wherein the bandgap reference circuit further comprises:

a first resistor coupled between the first amplifier input and the feedback node; and a second resistor coupled between the second amplifier input and the feedback node.

16. The circuit of claim 13, including:

a programmable analog circuit block, the programmable analog circuit block having analog circuit block positive and negative input terminals and analog circuit block positive and negative output terminals; and an analog routing pool, the analog routing pool controlling the muting of at least one of a signal provided by the programmable analog circuit block, and a signal provided to the programmable analog circuit block.

17. A circuit comprising:

a bandgap reference circuit including a differential amplifier having a first amplifier input, a second amplifier input, and an amplifier output;

a feedback node coupled to at least one of the first amplifier input and the second amplifier input; and a start-up circuit configured to prevent the bandgap reference circuit from settling into an intermediate voltage state, the start-up circuit comprising:

a current source; and a transistor coupled between the first amplifier input and the current source and responsive to a voltage derived from the feedback node, wherein the transistor is configured to push current from the current source into the first amplifier input if the voltage derived from the feedback node is indicative of the intermediate voltage state.

18. The circuit of claim 17, wherein the bandgap reference circuit includes a first bipolar transistor having a first base coupled to the first amplifier input, a second bipolar transistor having a second base coupled to the second amplifier input, and wherein the first base is coupled to the second base.

19. The circuit of claim 17 wherein the bandgap reference circuit further comprises:

a first resistor coupled between the feedback node and the first and second bases; and a second resistor coupled to the first and second bases.

20. The circuit of claim 17, including:

a programmable analog circuit block, the programmable analog circuit block having analog circuit block positive and negative input terminals and analog circuit block positive and negative output terminals; and an analog routing pool, the analog routing pool controlling the routing of at least one of a signal provided by the programmable analog circuit block, and a signal provided to the programmable analog circuit block.

* * * * *